United States Patent [19]

Grenthe

[11] Patent Number: 4,710,989

[45] Date of Patent: Dec. 8, 1987

[54] DRY CLOSET

[76] Inventor: Bo Grenthe, 17 Gyllenehimsgatan, Vänersborg, Sweden, S-462 00

[21] Appl. No.: 803,667

[22] Filed: Dec. 2, 1985

[30] Foreign Application Priority Data

Nov. 30, 1984 [SE] Sweden ..... 8406066

[51] Int. Cl.[4] ..... A47K 11/02; A47K 11/04

[52] U.S. Cl. ..... 4/449; 4/460; 4/476; 4/479

[58] Field of Search ..... 4/449, 484, 476, 460, 4/455, 479

[56] References Cited

U.S. PATENT DOCUMENTS

| | | | |
|---|---|---|---|
| 1,080,930 | 12/1913 | Schierding | 4/449 |
| 1,538,296 | 5/1925 | McDonald | 4/460 X |
| 2,893,017 | 7/1959 | Back | 4/484 X |
| 2,912,702 | 11/1959 | MacKenzie | 4/484 X |
| 3,001,206 | 9/1961 | Strehlke | 4/460 |
| 3,118,146 | 1/1964 | Dorey | 4/476 |
| 3,159,848 | 12/1964 | Kurrels | 4/484 |
| 3,435,464 | 4/1969 | Harding | 4/459 |
| 3,600,719 | 8/1971 | Karr | 4/484 |
| 3,772,712 | 11/1973 | Renn et al. | 4/484 |
| 4,536,902 | 8/1985 | McGill | 4/449 X |

FOREIGN PATENT DOCUMENTS 124192 3/1972 Norway .

*Primary Examiner*—Henry K. Artis

*Attorney, Agent, or Firm*—Cushman, Darby & Cushman

[57] ABSTRACT

Dry closet consisting of a bottom part (1) and an upper part (2), the bottom part containing an absorbing agent. The bottom part (1) is at delivery folded together by folding the walls a short distance up inwards over which an upper part (2) has been placed and the different parts are then kept together by a tape. The upper part (2) contains a seat and a lid and when used the sides of the bottom part are unfolded so that a greater height and volume is obtained and the upper part (2) is placed on the bottom part locking the unfolded sides of the bottom part (1), whereafter the closet is ready for use. When used to a sufficient extent the closet can be burned where it was used or in the close vicinity thereof.

6 Claims, 6 Drawing Figures

Fig. 1.
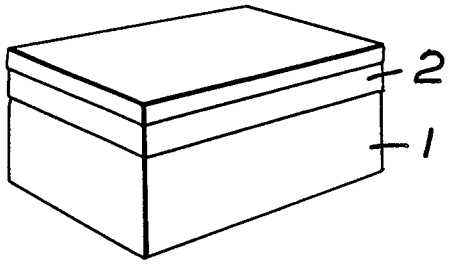
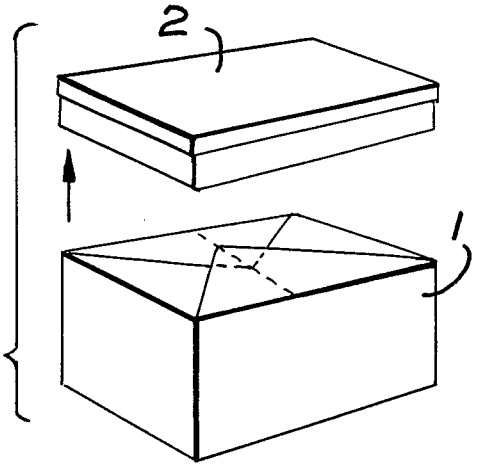
Fig. 2.
Fig. 3.
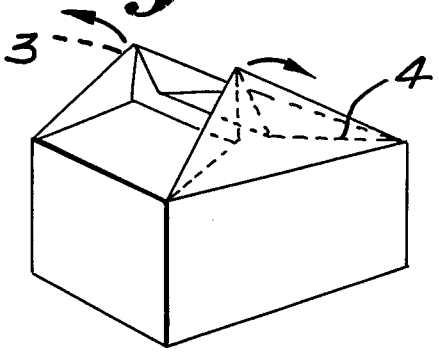
Fig. 4.
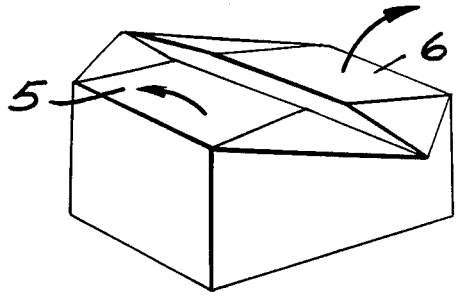
Fig. 5.
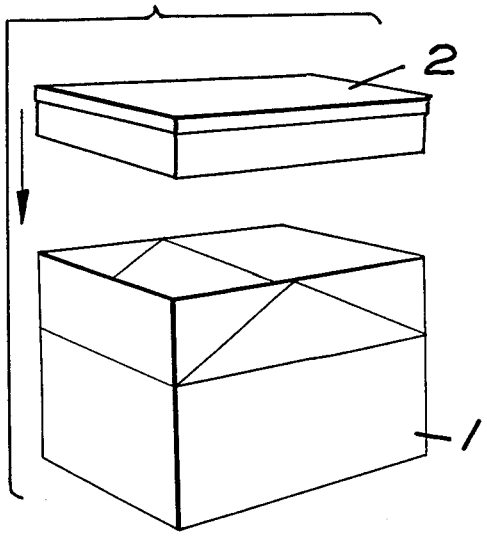
Fig. 6.
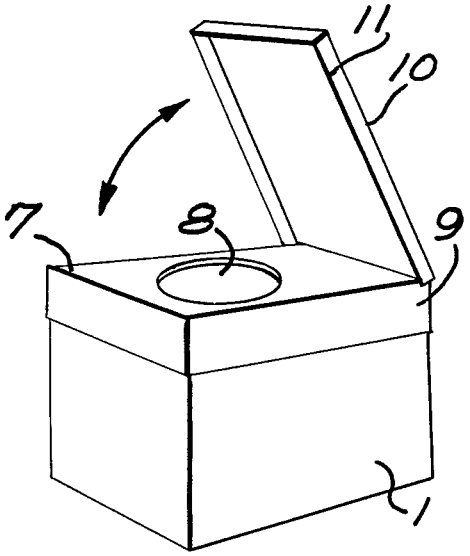

DRY CLOSET

Dry closets still have a function to fill, at such cases where the distance to a sewage system is too great alternatively where the need of a closet is of a more temporary character. Examples of this is for instance resting places along roads, in wood and country side and in archipelago islands. Furthermore, dry toilets are still in use at summer houses and in connection with temporary sports arrangements of the type orientation contests and ski contests. Furthermore it should not be forgotten in this context the military need of dry closets, even if this frequently is rendered relatively primitive solutions.

Hitherto however dry closets have required comparatively great resources as to handling, either one must as at the military variety dig a pit that then has to be closed gain. Alternatively one must provide for the collection of latrine vessels used in the dry closet and take these to appropriate municipal facilities. Of course the handling of latrine vessels, that often stand unsuitable and have to be transported long distances is problematic, back-damaging and essentially less esteemed occuption (which can be certified by everyone who at one time or another has come in contact with such jobs).

To start with the smell is disturbing and secondly the weights that have to be handled are not negligible, in particularily not when the latrine vessels often has to be made fairly robust in order to secure that no rusting-through takes place. As a result of these problems arrangements at today existing dry closets are often faulty alterntively one is forced to use far mor expensive solutions in the shape of mull-toilets and the like.

The object of the invention is to eliminate the above problems giving a particularly easily handled dry closet, that can be placed almost anywhere and how and that in most appliances allow a particularly simple handling without the risk of fouling and that furthermore eliminate the risk of bad smell.

In accordance with the invention the above object is solved by the dry closet consisting of a cardboard box in the upper end provided with a toilet seat and a corresponding opening in the roof of the cardboard box. The cardboard box is internally, as well as preferably even on the outside coated by a water sealing material in order to prevent a dissolving of the cardboard from the inside or outside. A suitable material for the construction of the cardboard box is corrugated cardboard or paperboard. In the cardboard box is furthermore suitable arranged an absorbing agent with a good ability not only to absorb water but preferably also with a neutralizing effect on those anaerobic processes that result in the bad smell normally associated with dry closets. This is preferably accomplished by using a porous and fluffy absorbing agent that by its absorption of the water results in a drying of the content of the closet. An example of suitable materials is flashdried reject from papermill industries since the flashdried reject has a very good absorption capability.

As is easily realized the entire closet can not be filled with an absorbing agent since then nothing more has any place in it. To start with the closet is only filled by an absorbing agent in a thick layer at the bottom. The closet can have it's filling of absorbing agent already from the start, so to say at delivery. In order further to economize the transporting of this closet in accordance with the invention it is preferably collapsable in such a way that it's inner space in collapsed position corresponds to the layer or filling of absorbing agent. In this context it should be mentioned that numerous absorbing agents, to which also belong the mentioned one based on reject from papermills, have the characteristic that they expend considerably from a previous more compressed state when they absorb water. Since the dry closet according to the invention is kept in a collapsed position a considerable gain in transport space is achieved. Since it is important that the folding of the dry closet is completely sealed this can for instance be established by folding two of the sides of the cardboard box inwards more of less as they are exept at the bending line between upper and lower part, whereas the intermediate sides are provided with bending lines angled 45°, going upwards inwards from the common bending level of the sides. By means of these angled bending lines it is possible to fold also the intermediate sides inwards. Above this is then placed a seat and a lid and the unit can for instance be held together by a tape or string going all the way round. When this closet in accordance with the invention is to be made use of, the string is cut, lid and seat are lifted of the sides of the closet are erected and the cover or seat is placed in the intended position, it can be apropriate to have seat and sides provided with co-operating fixing means rendering the connection more rigid. The closet lid is then suitable provided with hinge members and a suitable snap means to keep the lid in closed position. This since it is very well possible to consider use of the invented dry closet in more or less open air locations.

An essential advantage of the invented closet is that it can be made without the use of metal and other materials harmful to the enviroment, which in turn also means low weight and easy handling and furthermore, if so is desired, the complete closet including its content can acctually be burnt in situ, which in certain applications can lessen the handling costs conserably.

Further properties and advantages of the invention are apparent form the following detail description of an embodiment of the invention. In the drawings FIG. 1 shows the invented closet in its transport position, FIGS. 2–5 the preparing of the closet and FIG. 6 its position ready for use.

As is apparent from the transport-position of FIG. 1 of the invented closet this contains a bottom part 1 and an upper part 2. The sides of the bottom part are a short distance up folded inwards in order to diminish the transport volume, as is apparent from FIG. 2, where the upper part 2 has been removed. When the upper part 2 as is shown in FIG. 2 is removed from the folded bottom part 1 the sides of the bottom part 1, can be erected as is shown primarily in FIG. 3, where on opposing sides of the upper tabs 3 and 4 respectively of the sides are folded outwards to a position straight out from the lower part as is shown in FIG. 4. Hereafter the upper parts or tabs 5 and 6 respectively of the other two sides are bent outwards until the position of FIG. 5 is reached. The movements of the different parts in FIGS. 3 and 4 are shown by means of arrows. When the bottom part has been unfolded to the position shown in FIG. 5 the upper part is once again returned to its place on top of the bottom part.

From FIG. 6 it is apparent how the upper part 1 includes a seat 7 with an opening therein and a protruding edge 11 that with the lid in a closed position grip over the edges 9 of the upper part. Preferably the lid is provided with some kind of snap means for cooperation with the seat or its edges 9 in order to allow locking of the lid in closed position.

In the closet is then arranged a layer of an absorbing agent, that can have a volume up to that represented by the folded closet as it is shown in FIG. 1. At the fabrication of the closet it is filled and folded together in a way opposite to that to the above described (see FIG. 5-1).

The bending lines allowing the folding and unfolding of the sides kan be made in a known way but it is essential that in particular on the inside arranged sealing also cover the bending lines. The arrows in FIGS. 2–6 show the simple handgrips that make the invented dry closet ready for use.

In the ready for use position of FIG. 6 the lateral walls are stabilized by the edges 9 of the upper part 2. If it should turn out to be desirable to encrease this stabilizing furthermore the sides of the bottom part can have tabs at the upper edges capable of gripping into corresponding holes in the seat. The above mentioned bending lines or flexing lines can be made by perforating or compressing the material that is preferably constituted by corrugated cardboard. Preferably the closet is also at its outside coated by a water unpenetratable layer so that it can be placed on a wet support or outdoors without inconvenience.

Within the inventive thought it is of course also possible to consider other ways of folding and instead of folding the tabs 3 and 4 outwards while folding the sides 5 and 6 inwards these tabs 3 and 4 can instead by folded inwards under the tabs 5 and 6.

I claim:

1. A portable, disposable, combustible dry closet made of corrugated cardboard or paperboard comprising a box-like bottom part and an upper seat part of lid-like construction which includes a flat top wall having an opening therein, said bottom part having a bottom wall and upright side walls, the upper portions of said side walls being foldable inwardly, at a location above said bottom wall so as to reduce the height of said bottom part for storage or transport and also form an interior space between said location and said bottom wall for receiving absorbent material, and said side walls when not so folded forming an open top to said bottom part, said upper seat part being adapted to be fitted to said sidewalls when said side walls are either folded or unfolded.

2. A dry closet as in claim 1 having an inner surface which is waterproof.

3. A dry closet as in claim 1 having an outer surface which is waterproof.

4. A dry closet as in claim 1 wherein two opposing side walls of the bottom part are provided with bending lines inclined 45° so that all the side walls can be bent inwards without the need of any openings in the side walls of the bottom part.

5. A dry closet as in claim 1 wherein there are four sidewalls, two opposing sidewalls being foldable only along horizontal bending lines and each of the other two sidewalls being foldable along a horizontal bending line and inclined bending lines so as to form flaps.

6. A portable, disposable, combustible dry closet made of corrugataed cardboard or paperboard comprising a box-like bottom part and an upper seat part of lid-like construction which includes a flat top wall having an opening therein, said bottom part having a bottom wall and upright side walls, the upper portions of said side walls being foldable inwardly, at a location above said bottom wall, into a generally horizontal configuration which essentially closes said bottom part and which reduces the size of said bottom part for storage or transport, there being an interior space between said location and said bottom wall and bounded laterally by the lower portions of said side walls and said side walls when not so folded forming an open top to said bottom part, said upper seat part including depending peripheral edges which can grip exterior surfaces of said side walls in either the folded or unfolded condition and said upper part also including a flat lid having an edge hinged to an edge of said top wall and having depending edges which can grip the exterior of the depending edges of said top wall, and a mass of porous, fluffy, combustible water-absorbent material in said interior space, at least the exterior surfaces of said dry closet being water proof.

* * * * *